United States Patent [19]

Jokisch et al.

[11] Patent Number: 4,954,136

[45] Date of Patent: Sep. 4, 1990

[54] METHOD OF COOLING HOT PRODUCT GAS WITH ADHESIVE OR FUSIBLE PARTICLES

[75] Inventors: Friedrich Jokisch, Mühlheim/Ruhr; Adolf Linke, Essen; Hans-Christoph Pohl, Witten, all of Fed. Rep. of Germany

[73] Assignee: Krupp Koppers GmbH, Essen, Fed. Rep. of Germany

[21] Appl. No.: 347,333

[22] Filed: May 3, 1989

[30] Foreign Application Priority Data

May 13, 1988 [DE] Fed. Rep. of Germany ..... 3816340

[51] Int. Cl.[5] ..... C10J 3/46; C10J 3/84

[52] U.S. Cl. ..... 48/197 R; 48/210; 48/DIG. 2; 55/83; 55/84; 55/89; 261/67; 261/118

[58] Field of Search ..... 48/197 R, 206, 210, 48/DIG. 2; 261/115, DIG. 54, 116, 118, 67, 69.1; 55/83, 84, 89, 94; 208/489; 422/207; 252/373

[56] References Cited

U.S. PATENT DOCUMENTS

| | | | |
|---|---|---|---|
| 2,971,830 | 2/1961 | Kawai et al. | 48/206 |
| 3,456,928 | 7/1969 | Schway | 261/115 |
| 3,841,061 | 10/1969 | Pike | 261/DIG. 54 |
| 3,880,597 | 4/1975 | Goldschmidt et al. | 261/115 |
| 4,054,424 | 10/1977 | Staudinger et al. | 48/210 |
| 4,157,244 | 6/1979 | Gernhardt et al. | 48/210 |
| 4,172,708 | 10/1979 | Wu et al. | 55/83 |
| 4,581,899 | 4/1986 | Von Klock et al. | 48/197 R |

FOREIGN PATENT DOCUMENTS

| | | | |
|---|---|---|---|
| 2718539 | 11/1977 | Fed. Rep. of Germany | 48/206 |
| 3524802 | 1/1986 | Fed. Rep. of Germany . | |
| 872088 | 7/1961 | United Kingdom | 48/197 R |
| 2090544 | 7/1982 | United Kingdom | 261/115 |

OTHER PUBLICATIONS

Ullmann, vol. 1, 1951, p. 182, FIG. 332.

*Primary Examiner*—Peter Kratz
*Attorney, Agent, or Firm*—Michael J. Striker

[57] ABSTRACT

A method for cooling a hot product gas containing adhesive or fusible particles include injecting a ring-shaped jet of a cooling fluid into a gas to be cooled in a cooling zone in a flow direction of the gas, with separation of the jet into a plurality of individual cooling fluid jets with mass and penetration depths corresponding to the mass of product gas streams flowing through individual ring-shaped parts of the cooling zone. The injection speed of the cooling fluid jets are selected so as to obtain a desired penetration depth.

8 Claims, 4 Drawing Sheets

ṁ1
ṁ2
ṁ3
ṁ4
e1
e2
e3
e4
αi
4
2
43,75 %
31,25 %
18,75 %
6,25 %
D/4
D/2
3D/4
D 2
21
22
17
17
β
5
5
5
5
16
18
19
20
$\alpha_i$
6c
6b
6a
4
7
8
8
8
V
V
V
7
4
23
9
11
11
12
10
13
15
3
14
12
1

METHOD OF COOLING HOT PRODUCT GAS WITH ADHESIVE OR FUSIBLE PARTICLES

BACKGROUND OF THE INVENTION

The present invention relates to a method of and an arrangement for cooling a hot product gas with adhesive or fusible particles which lose their adhesiveness during cooling. More particularly, it relates to such a method and arrangement in accordance with which a ring-shaped jet of a cooling fluid is injected into the hot product gas in a cooling zone with a circular cross-section in a flow direction of the gas.

During cooling of hot product gases containing adhesive or fusible particles which lose their adhesiveness when they exceed a predetermined rigidifying temperature, there is a danger that these particles lead to deposits on the walls of the utilized apparatuses or respective installation parts due to baking. The effective growth of these deposits leads over time to the fact that the gas path in the utilized apparatuses gradually displaces and thereby the total installation becomes inoperative. A pronounced example for such a product gas which contains adhesive or fusible components is a partial oxidation gas recovered during the partial oxidation of coal and/or respective carbon carriers at temperatures above the slag melting point. The partial oxidation gas which leaves the gasifier with a temperature of 1200 to 1700° C. contains adhesive or fusible slag particles and/or respective tar components which lead to the above described deposits. During cooling and further treatment of such a gas, suitable measures must be taken which do not affect the cooling and subsequent processing steps by deposits on the walls of the utilized apparatuses, on the heat exchange surfaces and/or in the pipes.

It is known in principle to inject or nozzle a ring-shaped jet of a cooling fluid in the flow direction of the gases into the heat product gas stream for cooling the hot product gas. Such an introduction leads to a truncated-cone-shaped formation of the ring-shaped jet having a converging primary part and diverging secondary part when it is superposed on the product gas stream. The examples for the practical utilization for this cooling principle with the supply of the cooling fluid through a ring-shaped gap in the hot product gas stream have been known for a long time. This process is used for example during a so-called rolling gas process, in which a so-called return gas is admixed to the hot combustion gas for the temperature adjustment. This is disclosed, for example, in Ullmann, Volume 1, 1951, page 182, FIG. 332. Also, a toroid air heater operates on the same principle, in accordance with which the cold air is admixed to the hot combustion gas in a mixing chamber. Recently this principle has been also used for cooling of hot product gas which contains adhesive or fusible particles, especially for cooling of partial oxidation gas. This is disclosed for example, in the German document DE-OS 3,524,802. Due to the introduction of the cooling fluid through a ring-shaped gap, the wall contact of the particles is avoided and thereby the danger of deposits is precluded. It has been however shown that this object has not been achieved in a satisfactory manner. The recirculation flow formed on the edges of the truncated-cone-shaped cooling fluid jet does not retain the adhesive particles away of the walls, but instead leads them to the walls.

SUMMARY OF THE INVENTION

Accordingly, it is an object of the present invention to provide a method and an arrangement of the above-mentioned general type, which avoid the disadvantages of the prior art.

More particularly, it is an object of the present invention to provide a method of the above mentioned type in which a wall contact of adhesive or fusible particles during the cooling step is eliminated and the danger of baking or depositing is therefore excluded.

It is also an object of the present invention to provide in the above mentioned condition of baking and deposit preventing a complete and uniform mixing of product gas stream and cooling fluid.

In keeping with these objects and with others which will become apparent hereinafter, one feature of the present invention resides, briefly stated, in a method in which a ring-shaped jet is composed of a plurality of separate cooling fluid jets, whose mass and penetration depth corresponds to the mass of the product gas stream which flows in the individual ring-shaped chambers of the cooling zone, and the injection speeds of the cooling fluid jets are selected so that the desired penetration depth is obtained.

In accordance with another feature of the present invention an arrangement is provided with means for forming the ring-shaped jet of a plurality of separate cooling fluid jets with mass and penetration depths corresponding to the mass product gas stream flowing in individual ring-shaped chambers of the cooling zone, with the injecting speed of the cooling fluid jets selected to obtain the desired penetration depths.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

In accordance with the present invention, cooling of a hot product gas which contains adhesive or fusible particles is performed by assembling a ring-shaped jet from a plurality of separate cooling fluid jets with mass and penetration depth corresponding to the mass of the product gas stream flowing in the individual ring-shaped parts of the cooling zone and the penetration speeds of the cooling fluid jets are selected so as to obtain the desired penetration depth.

In contrast to a previously known process, the present invention no longer deals with the injection of the cooling fluid in form of a closed ring-shaped jet. Instead, the ring-shaped jet is subdivided into a plurality of separate individual jets which have partially different masses, partially different penetration depths and identical or partially different injection angles. Thereby the cooling fluid supply can be adapted to the mass of the product gas stream which flows in the individual ring-shaped parts of the cooling zone.

Figure 1:
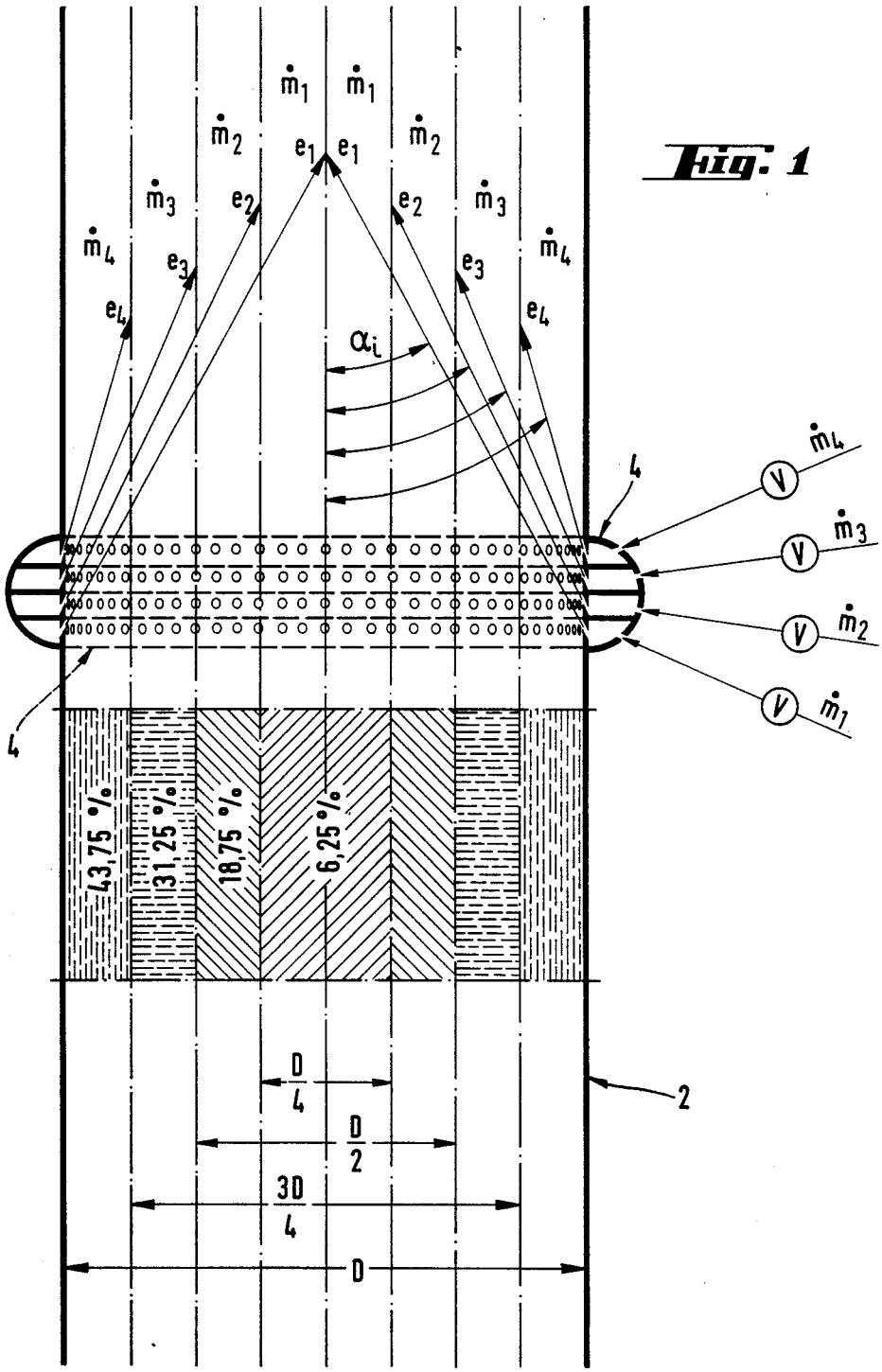
FIG. 1 is a view schematically showing a cross-section of a cooling zone.

FIG. 1 schematically shows the view of the cooling zone 2. A nozzle ring 4 for the injection of separate cooling fluid jets is located in the cooling zone 2. The diameter D of the cooling zone 2 is subdivided, for example, in 4 parts. The diameters $\frac{1}{4}$ D, 2/4 D, $\frac{3}{4}$ D and D limit in the cooling zone ring-shaped parts with different base surfaces, as can be seen from different hatching in the drawing. The percentage fraction of the base surfaces of the ring-shaped zones, the total surface of the cooling zone amount to 6.25%, 18.75%, 31.25% and 43.75% from inner to outer parts. With a constant flow speed of the product gas through the cross-section of the cooling zone, these percentage fractions are also true for the subdivision of the total mass of the product gas to different ring-shaped parts of the cooling zone. In correspondence with this different product gas masses, in the individual ring-shaped parts of the cooling zone different cooling fluid masses $\dot{m}_1$, $\dot{m}_2$, $\dot{m}_3$, $\dot{m}_4$, with different penetration depths $\alpha_1$, $\alpha_2$, $\alpha_3$, $\alpha_4$ are injected. The injection angles $L_1$ can be identical or different from one another for operational reasons. The injection speeds of the cooling fluid are selected so as to obtain the desired penetration depths. For example, the injection speeds are selected simultaneously so that during reaching the desired penetration depth, the vertical component of the jet average speed in the flow direction is equal to the speed of the total stream.

As mentioned hereinabove, the cooling of hot partial oxidation gas at temperatures between 1200 and 1700° C. is a preferable application of the inventive method. Other product gases for the use of the inventive method are such gases which contain adhesive or fusible particles, for example metals, salts or slags. A partial stream of the cold purified product gas can be used for example as a cooling fluid. Also other media can be used, such as for example steam or in some cases preheated water.

Figure 2:
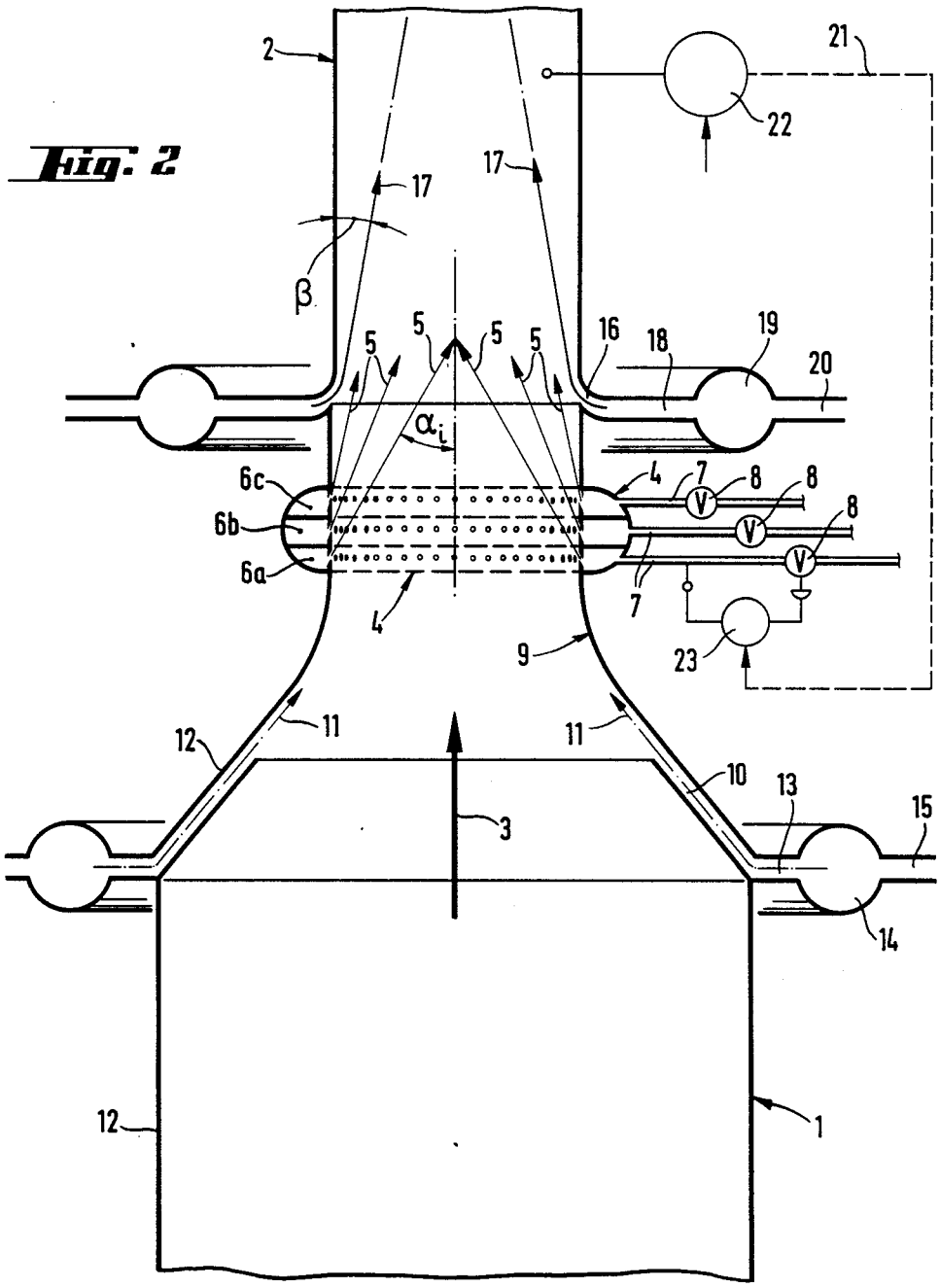
FIG. 2 is a longitudinal section, of an arrangement in accordance with the present invention.

FIG. 2 shows an upper part of a reactor 1 which serves for producing a product gas to be cooled, and a cooling zone 2 located directly over it. When the inventive method must be used for cooling of partial oxidation gas, the reactor 1 is a gasification reactor with known parts. Since the production of the respective product gas is not an object of the present invention, the structural details of the reactor 1 are not shown.

The cooling zone 2 has a circular cross-section. The produced product gas flows in direction of the arrow 3 from below upwardly from the reactor 1 into the cooling zone 2. In the arrangement shown in FIG. 2, the cooling fluid is supplied in three stages with different objects and different actions. The cooling itself of the product gas stream is performed by the cooling fluid jets which are injected through a nozzle ring 4 into the gas. The specific conditions of this cooling fluid supply is explained hereinabove. The different penetration depths of the individual cooling fluid jets are identified with the arrows 5 and obtained by different injection speeds. The different injection speeds are obtained by different pre-pressures in the chambers 6*a*, 6*b* and 6*c* formed in the nozzle ring 4 in this embodiment, and also by different nozzle diameters.

It is to be understood that the nozzle ring 4 can have a plurality of nozzles corresponding to the number of the required cooling fluid jets. They are not shown in the drawings. The nozzles are uniformly distributed over the whole periphery of the nozzle ring 4. The different cooling fluid masses are obtained by different number of nozzles with the same diameter.

As can be seen from the position of the arrows 5, the individual cooling fluid jets can have different injection angles. The injection angles $\alpha_i$ can be in the region between 0° and 90°. The corresponding injection angles are obtained by corresponding inclination of the nozzles on the nozzle ring 4. The injection speeds of the cooling fluid at the nozzle ring 4 are between 1 m/s and 100 m/s. The individual nozzles are connected through chamber 6*a*, 6*b* and 6*c* with conduits 7 which perform the supply of the required cooling fluid. The required pressure can be adjusted by valves 8.

For providing a flexibility of the operation, it can be advantageous to control the pressure of cooling fluid in the chambers 6*a*, 6*b* and 6*c* in dependence upon the gas temperature in the cooling zone 2. For this purpose, the gas temperature detected by the temperature measuring device 22 is used through a pulse conduit 21 as a control value for an adjusting device 23 of the valve 8. Thereby the valves can be opened or closed in dependence upon the measured temperature. This type of regulation is especially applicable when the product gas produced in the partial load operation in small quantities and therefore the cooling process can be performed only with a reduced cooling fluid quantity. This can lead to the fact that the cooling fluid supplied to individual nozzle groups can be completely interrupted. The above described regulation is illustrated only for the chamber 6*a* of the nozzle ring 4 to avoid complicated drawings. It is to be understood that this regulation can also be used for other chambers as well.

For maintaining a transition 9 from the upper part of the reactor 1 to the cooling zone 2 under the nozzle ring 4 free from baked deposits, a further cooling fluid stream is supplied through a ring-shaped gap 10 in direction of the arrow 11 parallel to the walls of the arrangement. This cooling fluid stream must retain the particles away from the reactor wall by their displacement. For obtaining an undisturbed limiting layer of the cooling fluid stream and producing particle paths with contours parallel to the walls of the reactor 1, the transition region 9 is formed so that its inclination change gradually merges in accordance with an exponential function into the cylindrical part of the cooling zone 2. The speed of the cooling fluid jet which is injected through the ring-shaped gap 10 lies in the region between 0.1 m/s and 50 m/s. The ring-shaped gap 10 is formed for example by offsetting the wall 12 in the upper part of the reactor 1, as can be seen in the drawing. The ring-shaped gap 10 is connected with a ring-shaped conduit 14 through a conduit 13. The ring-shaped conduit 14 is loaded with the required cooling fluid through a conduit 15.

A further cooling fluid stream is injected above the nozzle ring 4 through a ring-shaped gap 16 in the cooling zone 2. This cooling fluid stream is marked with the arrow 17. It must eliminate or suppress whirl and return flows which can produce by the injection of the cooling fluid through the nozzle ring 4 at the wall of the cooling zone 2. For this purpose the angle is correspondingly small, for example in the region between 0° and 45°, so as to insure that this cooling fluid stream itself does not produce return stream at the wall of the cooling zone 2. The speed of the cooling fluid stream is in the region between 1 m/s and 50 m/s. The ring-shaped gap 16 is connected through a conduit 18 with the ring conduit 19. The latter is supplied through the conduit 20 with the required cooling fluid.

As explained hereinabove, FIG. 2 is only a schematic showing of the inventive arrangement and does not represent special structural embodiments. For example, the walls of the reactor 1 and/or the cooling zone 2 can be formed as multi-pipe walls through which a cooling medium can flow and which can have a different embodiment on the manufacturing reasons which will be seen later on in connection with FIG. 4.

Figure 3:
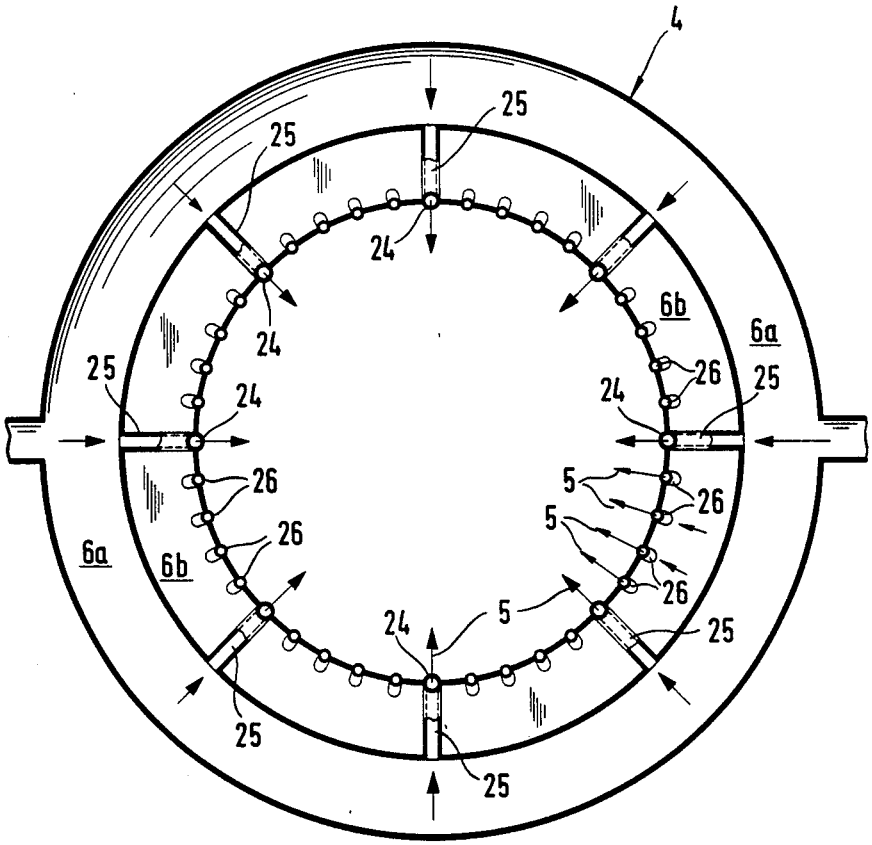
FIG. 3 is a view showing a cross-section of a nozzle ring with two chambers located one behind the other.

FIG. 3 shows a cross-section of another embodiment of the nozzle ring 4. In contrast to the embodiment of FIG. 2 the nozzle ring in this case has two chambers 6*a* and 6*b* located one behind the other. While in the embodiment of FIG. 2 the nozzle row of the individual chambers 6*a*, 6*b* and 6*c* are located over one another, in the embodiment of FIG. 3 all nozzles are located in the same plane. Nozzles 24 associated with the rear chamber 6*a* are connected by a conduit 25 with this chamber. Nozzles 26 associated with the front chamber 6*b* are provided directly in the chamber wall. It is to be understood that the nozzles 24 and 26 can have different diameters and/or inclination angles. As a rule, the nozzles associated with one nozzle chamber are identical.

Figure 4:
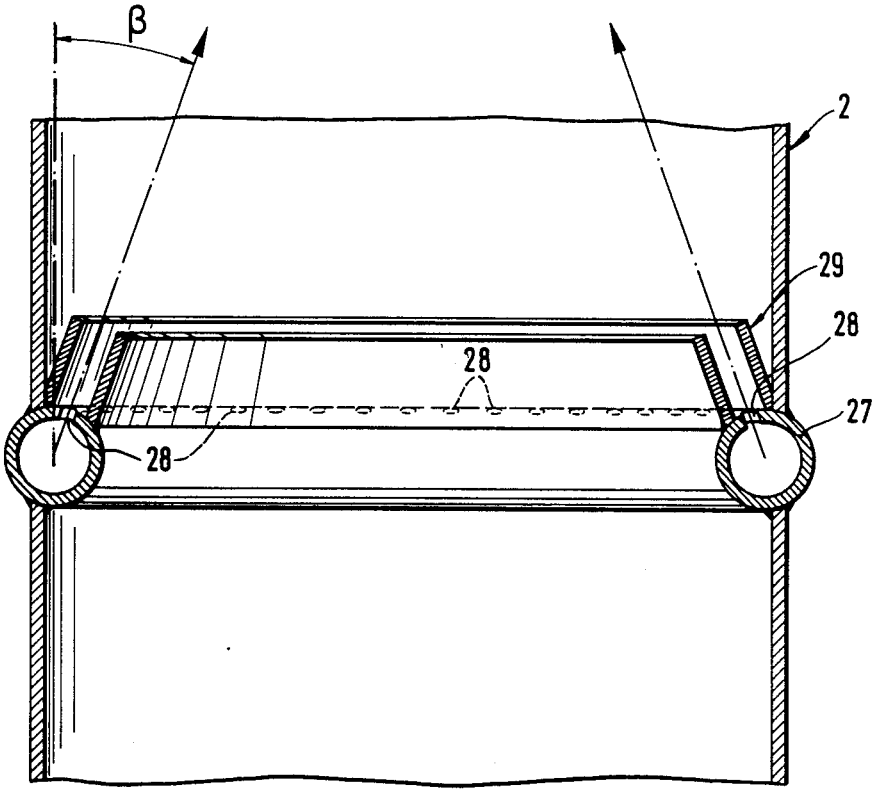
FIG. 4 is a view showing a longitudinal section through an embodiment of a cooling fluid supply above the nozzle ring.

FIG. 4 finally shows a longitudinal section of a special embodiment for the cooling fluid supply above the nozzle ring 4. While in the arrangement shown in FIG. 2 the cooling fluid is injected through the ring-shaped gap 16 in the cooling zone 2, the embodiment of FIG. 4 utilizes a nozzle ring 27, because of the manufacturing reasons. A guiding ring 29 is arranged on the nozzle ring 27 and opens upwardly. The guiding ring 29 insures that the cooling fluid jetsflowing out of the nozzles 28 are hydraulically uniform.

It will be understood that each of the elements described above, or two or more together, may also find a useful application in other types of constructions differing from the types described above.

While the invention has been illustrated and described as embodied in a method of and an arrangement for cooling hot product gases with adhesive or fusible particles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of cooling a hot product gas containing adhesive or fusible particles which lose their adhesiveness during cooling, comprising the steps of injecting into a hot product gas in a cooling zone with a circular cross-section in a flow direction of the gas a plurality of separate individual cooling fluid jets which together form a total ring-shaped cooling fluid jet and said separate jets being supplied with cooling medium via a plurality of plenums and controls to have different masses and different penetration depths correspond to different amounts of product gas stream flowing in individual ring-shaped parts of the cooling zone; and selecting the injection speeds of the individual cooling fluid jets so that desired penetration depths are obtained.

2. A method as defined in claim 1, wherein said selecting includes selecting the injection speeds of the individual cooling fluid jets simultaneously so that upon reaching the desired penetration depth, a vertical component of an average speed of the individual cooling fluid jets in the flow direction is equal to a speed of the total cooling fluid flow.

3. A method as defined in claim 1, wherein said injecting includes injecting the individual cooling fluid jets through a nozzle ring with a speed of between 1 m/s and 100 m/s and with an injection angle $\alpha$ from 0° to 90° into the product gas.

4. A method as defined in claim 3; and further comprising the step of controlling a pressure of the cooling fluid in the nozzle ring in dependence upon a gas temperature in the cooling zone.

5. A method as defined in claim 3; and further comprising the step of injection a further cooling fluid stream above the nozzle ring and a further cooling fluid stream below the nozzle ring into the product gas.

6. A method as defined in claim 3, wherein said step of injecting the further cooling fluid stream below the nozzle ring includes injecting the same with a speed of between 0.1 m/s and 50 m/s so that it is injected in the product gas with a flow in the region above the nozzle ring.

7. A method as defined in claim 5, wherein said step of injecting the further cooling fluid stream above the nozzle ring includes injecting the same with a speed of between 1 m/s and 50 m/s and with an angle $\beta$ between 0° and 45° to the product gas stream.

8. A method as defined in claim 1, wherein said product gas is a partial oxidation gas produced at temperature above a slog melting temperature and by partial oxidation of a material selected from the group consisting of coal, carbon carriers and both.

* * * * *